United States Patent [19]

Segard

[11] 4,277,914

[45] Jul. 14, 1981

[54] APPARATUS FOR GRINDING ARTICLES WITH TWO ROTATING GRINDING DISCS

[75] Inventor: Yves-Andre Segard, Morges, Switzerland

[73] Assignee: Etablissements Sim S.A., Switzerland

[21] Appl. No.: 41,108

[22] Filed: May 21, 1979

[30] Foreign Application Priority Data

May 29, 1978 [CH] Switzerland ..... 5836/78
Nov. 20, 1978 [CH] Switzerland ..... 11859/78

[51] Int. Cl.[3] ..... B24B 7/16

[52] U.S. Cl. ..... 51/112; 51/116; 51/290

[58] Field of Search ..... 51/111 R, 112, 116, 51/117, 215 R, 290

[56] References Cited

U.S. PATENT DOCUMENTS

| | | | |
|---|---|---|---|
| 2,089,040 | 8/1937 | Shue | 51/111 R |
| 2,636,322 | 4/1953 | Carlson et al. | 51/112 |
| 3,889,428 | 6/1975 | Steinegger et al. | 51/112 |

FOREIGN PATENT DOCUMENTS

| | | | |
|---|---|---|---|
| 957018 | 1/1957 | Fed. Rep. of Germany | 51/116 |
| 2253783 | 11/1971 | Fed. Rep. of Germany | 51/112 |
| 2402005 | 7/1975 | Fed. Rep. of Germany | 51/116 |
| 427547 | 6/1967 | Switzerland | 51/116 |

*Primary Examiner*—Gary L. Smith
*Assistant Examiner*—Robert P. Olszewski
*Attorney, Agent, or Firm*—McGlew and Tuttle

[57] ABSTRACT

A grinding device for grinding the end surfaces of articles, such as cylinders or rings, comprises, first and second grinding discs which are mounted in spaced apart relationship by an amount substantially equal to the distance between the ends of the articles to be ground and with their axes offset from each other by a spacing therebetween so that the discs define an overlapped space therebetween having an entrance apex at which the area of overlap begins and an exit apex at which the area of overlap ends. The discs are rotated in respective opposite directions and the articles are delivered into one apex, such as the entrance apex, and the rotation and speed of the discs are such that they are urged by the discs to move toward the opposite or discharge apex where they are separated from the discs. The angular speeds of the two grinding discs determines the path of the workpieces through the overlapped zone between the discs. With the method of the invention, the workpieces are guided up to an entrance apex of the discs and the discs are rotated at selected speeds and in opposite directions so as to cause the articles fed therebetween to be engaged by the discs and moved through a feeding path therebetween during which they are ground and discharged at the opposite apex. The method makes it possible to feed the articles to be ground through an entrance apex and a discharge apex which are located on the same side as the two overlapped discs.

4 Claims, 8 Drawing Figures

Fig. 4
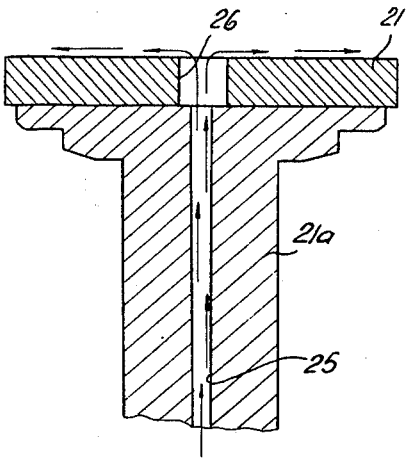
Fig. 6
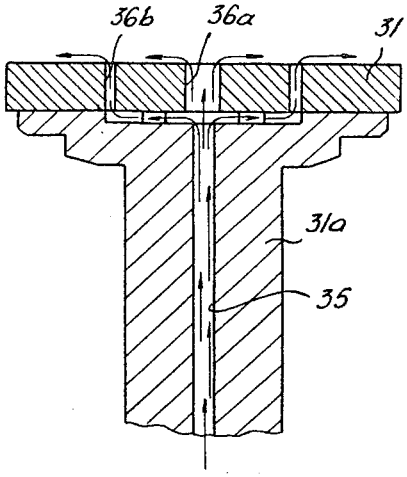
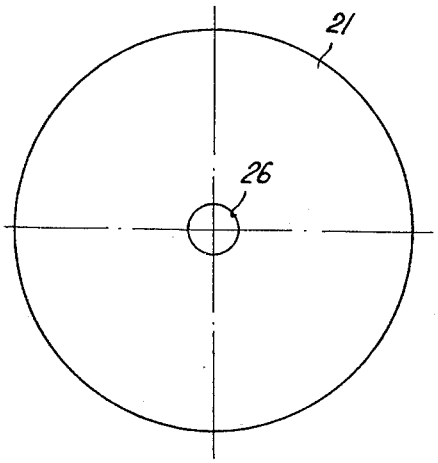
Fig. 5
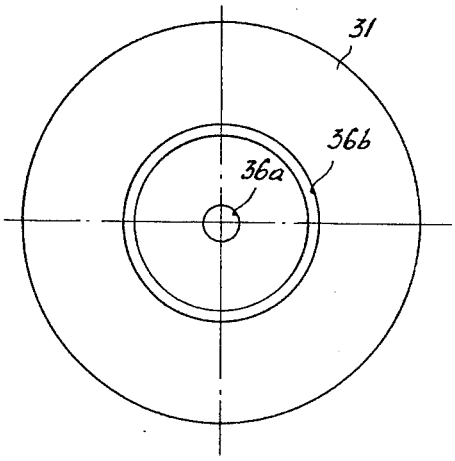
Fig. 7

APPARATUS FOR GRINDING ARTICLES WITH TWO ROTATING GRINDING DISCS

FIELD AND BACKGROUND OF THE INVENTION

This invention relates to grinding devices in general and, in particular, to a new and useful twin disc surface grinding machine which can be used, for example, for the surface grinding of the parallel end faces of rollers or rings, particularly open piston rings.

DESCRIPTION OF THE PRIOR ART

In machines of this type, the workpieces to be machined are conducted between two spaced planar discs arranged parallel to each other, and are surface-ground during their passage. A machine of this type is known, for example, from Swiss Pat. No. 427,547, in which the feed of the workpieces between the two coaxial grinding discs is effected forcibly by means of a guide wheel with fitting circumferential recesses or bores for the workpieces. In other known machines of ths type, the workpieces are held in their path through the grinding disc spacing between parallel guide bars, and they are pushed by suitable conveyor means through the guide conduit thus created.

A common feature of all of these prior art machines is that the elements required for guiding the workpieces are slightly narrower than the spacing of the grinding discs. Moreover the guide elements must be mounted very carefully to avoid any direct contact with the grinding disc. The spacing between grinding discs for working particularly small width workpieces, such as piston rings is quite small. Accordingly, the corresponding guide wheels or guide bars are so narrow that the forces produced during the grinding process can lead to their deformation, and thus, to damage by the grinding discs. Since the workpieces in the known machines cannot evade the forces acting on them during the grinding, due to the forced guidance of the workpieces, deformation of the workpieces, in the case of thin-walled or open rings can result.

SUMMARY OF THE INVENTION

The present invention provides a grinding machine wherein the above-mentioned drawbacks are avoided. The machine of the invention is characterized in that the grinding discs are arranged in spaced parallel planes and are driven in opposite directions with their axes arranged parallel to each other, with the axial spacing being only a fraction of the disc radius. The work feed is provided in the range of the apex of the overlapping zone of the two grinding discs in which the circumferential speeds are oppositely directed, and where the angular speeds of the two grinding discs determine the path of the workpieces through the overlapping zone.

Due to this arrangement, the workpieces fed into the apex range of the overlaping zone of the two discs are subjected by the action of the grinding discs to a force directed toward and away from a plane extending through the disc axes. This force tends to move the workpieces on a selected linear or curved path toward the opposite apex range of the overlapping zone. Even if guide elements are not provided between the grinding discs, the workpieces per se will tend to move through the overlapping zone and through the opposite apex zone from between the discs. Apart from the fact that this eliminates any necessity of a forced guidance of the workpieces through the grinding zone, all elementary parts of the workpieces taking part in the grinding process are stressed in the same manner, so that no stresses leading to deformation or rupture can appear in workpieces with axially and/or radially very thin walls, and particularly in the form of open rings.

The speed of passage of the workpieces depends not only on the circumferential speed of the grinding discs and their diameter, but also on the axial spacing between the grinding discs. The smaller this distance, the lower the speed of passage, and the longer the grinding time.

Inequalities of the two grinding discs caused by manufacture or wear, or a feed of the workpieces, not exactly at a right angle to the axial plane of the discs in the overlapping apex can have the effect that the workpieces do not follow the theoretically ideal path (straight line or circular arc) through the overlapping zone of the two discs. In order to avoid excessive lateral deflection of the workpieces, it may therefore be advisable to provide auxiliary guides at least in the inlet range, and/or to arrange the two discs inside of a protective hood covering the disc halves at the inlet end and their interval in such a way that any laterally deflected workpieces can only leave the grinding disc range at the outlet side.

Accordingly, an object of the present invention is to provide a grinding device for grinding the end surfaces of articles, such as cylinders, rings, etc., which comprises first and second grinding discs which are mounted in spaced apart, substantially parallel arrangement, with their axes offset from each other by a spacing therebetween so that the discs define a space therebetween in the area of disc overlap which has an entrance apex at which the area of overlap begins and an exit apex at which the area of overlap ends, and in which the discs are rotated in respective opposite directions and the articles for grinding are delivered into one apex, such as the entrance apex, to engage between the discs and, wherein, the discs by their opposite direction of rotation tend to move the articles as they are ground to the exit apex for movement out of engagement between the discs.

Another object of the present invention is to provide a method of grinding the ends of workpieces using pairs of overlapped spaced apart discs or grinding wheels which are spaced apart by substantially the spacing of the articles to be ground, which comprises, feeding the workpiece between the discs so that the ends of the workpiece which are to be ground are engaged with respective ones of the discs, rotating the discs in respective opposite directions and at speeds to regulate the path of movement of the articles between the discs from the point at which they are initially engaged therebetween to a discharge point in which they are moved out of contact between the discs and so as to grind the ends of the disc during their passage.

Still another object of the invention is to provide in a grinding machine, a grinding device for grinding cylindrical articles, such as cylinders and rings, adopted to be ground on opposite end surfaces thereof. The grinding device includes a first rotatable grinding disc, a second rotatable grinding disc, means for vertically mounting said first rotatable grinding disc at said second rotatable grinding disc in a substantially parallel spaced relationship to define a spacing between adjacent spaces of the disc substantially equal to the distance between the opposite end surfaces of the articles to be ground. The adjacent faces of the disc are circular. Each disc has a substantially horizontal axis parallel to and disposed at a spaced distance from the horizontal axis of the other disc to define an area of overlap in respect to the adjacent faces. The spaced distance is not more than five percent of the radius of each disc. Means are further provided for rotating each disc in opposite directions relative to the other at individually selected speeds of rotation. Means are further provided for delivering the articles to be ground to the area of overlap through an entrance apex to the spacing defined by a first overlap of the periphery or circumference of each disc relative to the other. The rotating means is operative to oppositely rotate each disc relative to the other at selected speeds to pass the articles from the entrance apex through a path in the area of overlap to a discharge apex from the spacing defined by a second overlap of the periphery or circumference of each disc relative to the other. The path is defined as a function of the selected speeds and can be varied by varying the speeds.

A futher object of the invention is to provide a device for grinding articles which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings descriptive matter in which preferred embodiments of the invention are illustrated.

BRIEF DESCRIPTION OF THE DRAWINGS

In the drawings:

FIG. 4 is an enlarged axial sectional view indicating the manner of forming grinding discs with liquid cooling channels;

FIG. 5 is a top plan view of the disc shown in FIG. 4;

FIG. 6 is a view similar to FIG. 4 of another embodiment of the invention;

FIG. 7 is a top plan view of the embodiment shown in FIG. 6; and

DESCRIPTION OF THE PREFERRED EMBODIMENTS

Figure 1:
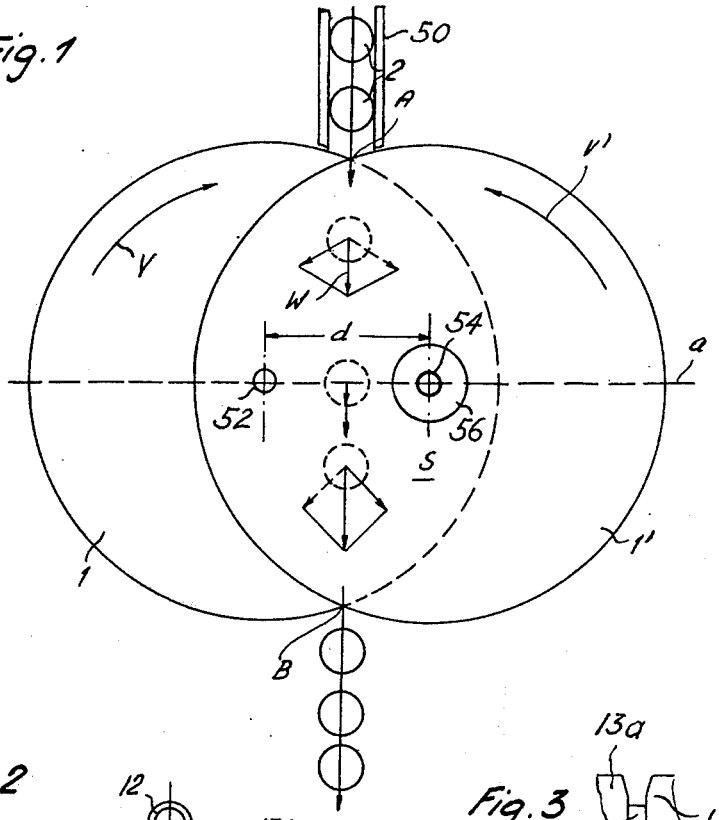
FIG. 1 is a top perspective view of a grinding device for grinding cylindrical articles, constructed in accordance with the invention.

Referring to the drawings in particular, the invention embodied therein in FIG. 1, comprises, a grinding device for grinding the end surfaces of articles, such as cylinders 2, which are delivered by delivery means 50 into a space between substantially parallel grinding discs 1 and 1' which are spaced apart by an amount comparable to the thickness of the articles to be ground, and so as to contact each edge thereof or surface thereof to effect grinding as they are moved therebetween.

In accordance with the invention, the grinding discs 1 and 1' have axles or axes 52 and 54 which are spaced apart by a spacing or distance therebetween d. The grinding discs 1 and 1' define an area of overlap which is shown in FIG. 1 by the letter S. An entrance into this overlapped area is defined by an apex or entrance A and a discharge or similar apex is defined by the letter B. The location of the entrance or the discharge depends, of course, on the rotation of the discs.

In the embodiment of the invention shown in FIG. 1, the discs 1 and 1' are rotated in respective opposite directions as indicated by velocity arrows V and V' in FIG. 1. For this purpose, drive means 56 is connected to both axles 52 and 54 and, in addition to imparting separate driving rotations of the discs, it also provides differences of speed of rotations of the discs so as to control the movement of the articles 2 in the overlap zone S so that the articles will move in a desired pattern to effect the grinding thereof and the discharge of the articles beyond the apex B of association with the disc after they are fully ground.

The parallel axes of the two discs 1 and 1' are arranged in a spacing or at a distance d from each other, so that an overlapping zone S is formed between an entrance or disc first apex A and an exit or disc second apex B of the overlapped zone of the two discs. The two parallel disc planes have a spacing which is equal to the distance of the end surfaces of workpieces 2 which are to be surface-ground. Discs 1 and 1' are driven in respective opposite directions at equal circumferential speeds V. In the vicinity of apex A of overlapping zone S, which is at the top of FIG. 1, the circumferential speeds V of the two discs 1 and 1' are oppositely directed.

The first disc apex A is the entrance point of the feed of the workpieces, 2. Each workpiece fed into apex A of overlapping zone S, is driven at a speed W directed at a right angle in respect to the common axial plane a, which extends through the axes of both grinding discs, and toward the other opposite overlapping apex B in FIG. 1, due to the opposite rotation of the grinding discs. Accordingly, the ground workpieces 2 leave the overlapping zone at apex B. It should be pointed out that this movement of the workpieces through grinding zone S is completely independent of the position of grinding disc plane a which can extend in horizontal, vertical or in any inclined direction, since the weight of the relatively easy to machine workpieces can hardly influence their traveling movement.

Figure 2:
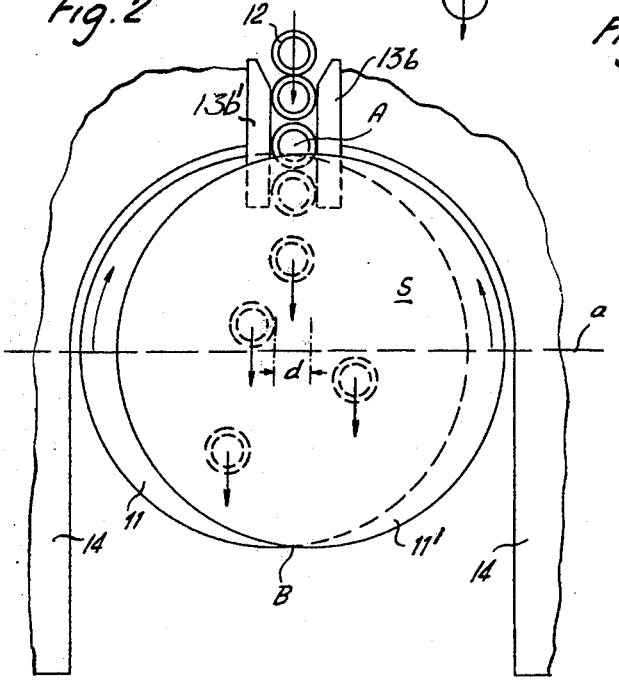
FIG. 2 is a view similar to FIG. 1 of another embodiment of the invention.
Figure 3:
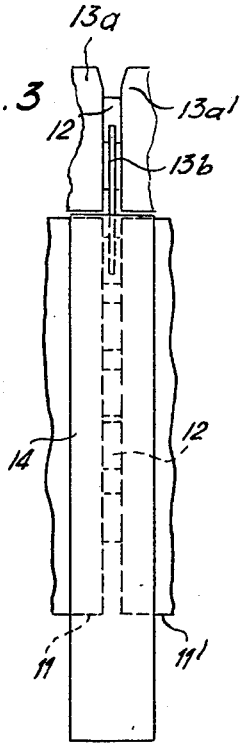
FIG. 3 is a side elevational view of the portion of the machine shown in FIG. 2.

As shown in FIGS. 2 and 3, grinding discs 11 and 11', having relatively large overlapping surfaces, are arranged with their axes in a common horizontal plane. The feed of the workpieces, represented by the rings 12, is effected through a guided conduit in the area of the upper overlapping apex A of grinding zone S bonded laterally by sides 13*a* and plates 13*a'* aligned with the working surfaces of grinding discs 11,/11' and by narrow bars 13*b* and 13*b'*. Bars 13*b* and 13*b'* protrude by a certain amount between the two grinding discs 11 and 11' to ensure that workpieces 12 arrive properly in grinding zone S. In grinding zone S, the area of disc overlap, the workpieces are automatically moved downwardly by the oppositely rotating grinding discs 11 and 11', due to the downwardly directed resultant driving forces acting on them. The workpieces leave grinding zone S in the range of the lower overlapping apex B.

Inaccuracies in the feed and inequalities in the working surfaces of the grinding surfaces, which can hardly be avoided, cause a deviation in the movement of the workpieces 12 from a path exactly perpendicular to plane a through the grinding zone S connecting apices A and B. However, this is hardly a disadvantage since the paths and stay periods of the workpieces and the resultant force acting on the workpieces hardly differ in the grinding zone. In order to make sure that even workpieces which are laterally deflected leave grinding zone S at the bottom, the two discs 11 and 11' and their interval or offset created by their axial spacing are covered at the top and at the side by hood 14 connected with the associated disc supports. Bars 13*b*, 13*b'* could also extend through the entire grinding zone up to or beyond apex B.

The working surfaces and the workpieces, respectively, in surfacing grinding machines must usually be cooled. The cooling fluid is preferably fed through the axles of the grinding discs 11 and 11' to the grinding zone.

In the embodiment shown in FIGS. 4 and 5, axle 21*a* of each grinding disc 21 (or disc 11 or 11') is provided with an axial bore 25 which terminates in a central disc bore 26. The cooling fluid spreads by centrifugal action over the entire working surface of grinding disc 21. The supply of the cooling fluid exclusively in the disc center can under certain circumstances lead to such a strong radial cooling current on the working surface of the disc that the movement of the workpieces through the grinding zone is adversely effected by it. It is therefore also possible to feed only a part of the cooling fluid to the disc center, while another part is applied through a coaxial ring conduit in the working surface of the grinding disc at a radial distance from the center. Such an embodiment is shown in FIGS. 6 and 7.

Only a part of the cooling fluid is fed through axial bore 35 of disc axle 31*a* to a central bore 36*a* with a correspondingly reduced diameter while the rest flows radially outwardly through a coaxial ring conduit 36*b* to the working surface of disc 31. Naturally, the width of the ring conduit 36*b* is made small so that the workpieces crossing it during the grinding are not adversely affected.

Due to the above-described design of the surface grinding machine, it is possible to surface-grind even workpieces with smaller axial and/or radial dimensions or lesser inherent stability, such as open piston rings, for example. With a given circumferential speed and diameter of the grinding discs, the speed of passage of the workpieces and their stay period, respectively, in the grinding zone depends on the axial distance d of the two discs, that is, the greater the axial distance, the higher the speed of passage and the shorter the stay period. This results from the formula $$W=(V\cdot d)/D$$

where

W = theoretical speed of passage of the workpieces
V = circumferential speed of the grinding discs
D = disc diameter and
d = axial distance of the discs.

For example, practical tests have shown that with V = 26 m/s, D = 660 mm, and d between 10 and 30 mm, speeds of passage of about 30 to 60 m/min. can be achieved, which corresponds to the usual values in surface grinding machines. Since the axial distance of the discs is relatively small, that is, preferably only a fraction of the disc radius, this results in a relatively long path of the workpieces, which corresponds practically to the disc diameter, even when they do not exactly follow the line connecting the grinding zone apices. The grinding conditions are thus equal for all workpieces. A relatively minor variation of the axial distance d is sufficient to change the speed of passage.

Under the above-mentioned conditions of equal angular speeds of the oppositely driven grinding discs, it was possible to achieve that the workpieces fed to the two discs in the range of one apex of the overlapping zone travel under the action of the grinding discs substantially along a straight line to the other apex, and are stopped there. This substantially linear feed of the workpieces, effected by the grinding discs themselves, has almost necessarily the effect that the feeding and removal of the workpieces must be effected on different sides of the machine, which has certain disadvantages. In addition, the length of the path is always given by the length of the line connecting the apices. since the axial displacement is for the most part very small, this linear path leads almost necessarily through the close-to-center middle portion of the discs where the grinding action is insufficient because of the low speed.

In the embodiment described below, all of the above-mentioned limitations have been eliminated. To this end, the angular speeds of the two oppositely driven grinding discs are different in this embodiment and are selected so that the path of the workpieces through the overlapping zone produced by the action of the grinding discs is substantially a circular arc. This makes it possible to provide the feeding point and the removal point of the workpieces on the same side of the machine, if desired.

Since the axial displacement of the grinding discs is, for the most part, very small, the path of the workpieces, in a rectilinear passage, leads necessarily through the range of the disc center, where the grinding action is insufficient, because of the low speed of rotation. A circular path, on the other hand, can be conducted in a suitable distance around this central range.

With different angular speeds of the two discs, the disc diameters and feeding points of the workpieces can be selected so that the bisection of the tangent lines to the discs is in an apex of the overlapping zone, and the feed of the workpieces in the direction of the bisecting line of the tangents to the two discs can be effected in the said apex.

It has been found that the radius of the circular path of the workpieces, passing between the two oppositely driven discs having axes $0_1$ and $0_2$, displaced by the amounted, and having angular speeds $\omega_1$ and $\omega_2$, has its center located at a distance x from the axis of one disc in the common axial plane, that passes through the axes. The distance x is determined by the equation:

$$x = \frac{d \cdot \omega_2}{\omega_2 - \omega_1}.$$

This means that the workpieces are so moved by the action of the two grinding discs as if they were moved by a fictitious third disc whose axis $0_3$ is at the above-mentioned distance x from axis $0_2$. Such an embodiment is represented schematically by way of example in FIG. 8.

The two grinding discs 41 and 42 are arranged in a parallel spaced relationship to each other with their axes $0_1$ and $0_2$ in the same horizontal plane. The spacing of their working surfaces facing each other corresponds to the nominal distance of the workpiece surfaces to be ground. The relatively small displacement or spacing between the axes of the discs 41, 42 is 1% to 3%, or in certain cases, up to 5% of the disc radius, and is designated d. The outside diameter of disc 41 is slightly greater than that of disc 42, which has the result that the two apices A and B of the overlapping zone, which is unsymmetrical with regard to the connecting line of these apices, is displaced from the axis-parallel veritcal center plane toward the side of the smaller disc, that is, they are on the same side of the machine.

The two grinding discs 41 and 42 are provided with a relatively large central opening 41*a* and 42*a*, respectively, supply cooling fluid to the grinding zone, and accordingly, the working surface of each grinding disc is combined to the area outside the central zone, since the grinding action in the central zone would be poor, due to the low speed of rotation (it is zero in the center) and the wear of the grinding surface would be undesirably great. The radii of the two central openings 41*a* and 42*a* differ from each other by the amount of the axial displacement of the grinding discs, so that the two cross-sectional circles meet in the horizontal plane through axes $0_1$ and $0_2$. The angular speed $\omega_1$ of grinding disc 41 is slightly lower, preferably by 1% to 5%, than the angular speed $\omega_2$ of disc 42, so that the circumferential speed of the two grinding discs 41 and 42, which only differ slightly in size, is identical. These circumferential speeds of the oppositely driven grinding discs 41 and 42 are directed toward each other in the upper overlapping apex A according to the drawing and away from each other in the lower overlapping apex B.

Apex A is provided as a feeding point for workpieces 43, which are known here as cylindrical rings, while the lower apex B forms the outlet point. The actual value of the angular speeds $\omega_1$ and $\omega_2$ and of the displacement d is selected so that the position of axis $0_3$ results from the relation mentioned for x, while the size of the outside and inside diameter of the grinding discs 41 and 42 is selected so that the circular arc with the center $O_3$ resulting for the passage of the workpieces through the overlapping zone and through apices A and B, passes through the range of contact point C of the circles corresponding to the central openings 41*a*, 42*a* of the discs so that the workpieces project at this point C over the edge of the central openings with a part of their diameter.

The feeding device for workpieces 43 is designated 44. In order to ensure exactly the circular path y of the workpieces resulting necessarily under that action of grinding discs 41, 42 (inaccuracies of the dimensions and speeds of the discs, as well as of the grinding surfaces themselves, weight and quality of the workpieces, etc., can lead to deviations from the theoretically determined path), a positive guide is provided, which is formed by corresponding segments 45*a*, 45*b*.

Figure 8:
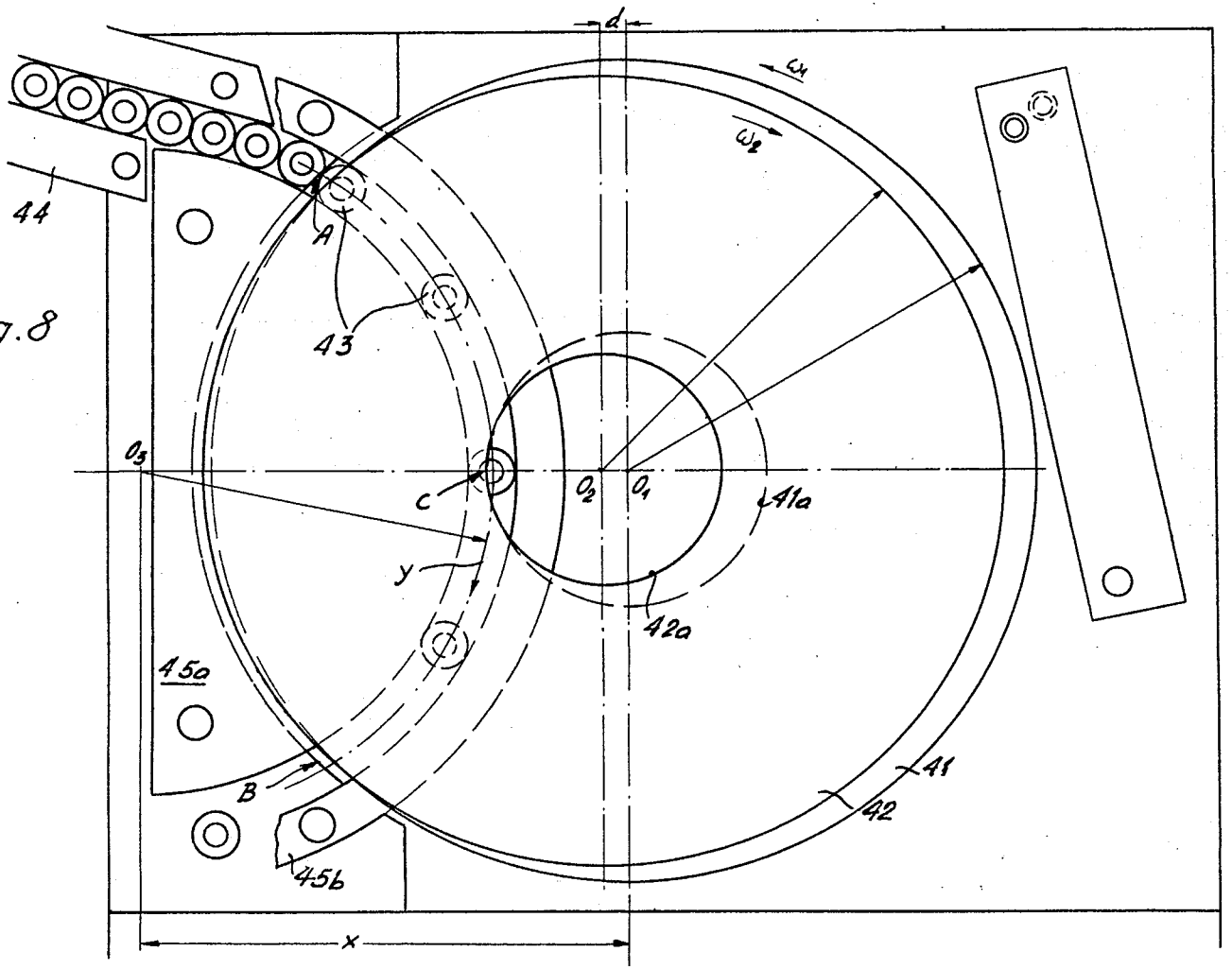
FIG. 8 is a view similar to FIG. 1 of still another embodiment of the invention.

As can be seen from FIG. 8, the workpieces overlap with a part (preferably with about $\frac{1}{4}$ to $\frac{1}{3}$) of their diameter over the edge of the central openings 41*a*, 42*a* of grinding discs 41, 42. This ensures that the entire working surface of the grinding discs extending up to the central opening acts on the workpieces. If this were not the case, shoulders or steps could be formed in the grinding disc by the wear between used and unused portions of the working surface, which would be passed tangentially by the workpieces, resulting in undesired markings on the workpieces.

Naturally, a wheel holding the workpieces in recesses could also be provided instead of guide segments 45*a* and 45*b*. The axial displacment of the grinding disc, which acts on the predetermined path through the grinding zone in the sense of a forced feed of the workpieces, facilitates the feeding of the workpieces, so that no great pushing or pressing forces are required, which is of particular advantage in thin-walled, easily deformable workpieces, such as piston rings. However, the arc form of the path effected by axial displacement and the different angular speed of the two grinding discs are essential. This permits, on the one hand, the passing of the workpieces during their passage in a sufficient distance from the central portions of the grinding discs (having an insufficient grinding speed) and, on the other hand, it keeps the length of the passage and the stay period of the workpieces in the grinding zone sufficiently long. It was found, in particular, that the grinding discs perform several revolutions during the passage of a workpiece, which is necessary for the satisfactory surface grinding of the workpiece surfaces. In order to obtain sufficiently large grinding zones, the axial displacement of the grinding discs should be small.

The foregoing considerations show that an essential feature of the present invention consists in that a path of motion can be determined for the workpieces by suitable selection of the different angular speeds of the two axially displaced and oppositely driven grinding discs, which leads through the grinding zone at least substantially in the form of a circular arc symmetrical to the horizontal plane through the disc axes in such a way that no or only minor additional guiding forces must be exerted on the workpieces during this passage and, it is possible, for example, to provide the suitable point for feeding or removing the workpieces on the same side of the machine. This path can be selected so that the central portions of the grinding discs can rotate with their too low grinding speeds in a sufficient distance.

While specific embodiments of the invention have been shown and described in detail to illustrate the application of the principles of the invention, it will be understood that the invention may be embodied otherwise without departing from such principles.

What is claimed is:

1. In a grinding machine, a grinding device for grinding cylindrical articles, such as cylinders and rings, adapted to be ground on opposite end surfaces, comprising a first rotatable grinding disc, a second rotatable grinding disc, means for vertically mounting said first rotatable grinding disc and said second rotatable grinding disc in a substantially parallel spaced relationship to define a spacing adjacent faces of the discs substantially equal to the distance between the opposite end surfaces of the articles to be ground, said adjacent faces being circular, said grinding discs having unequal outside diameters, each disc having a substantially horizontal axis parallel to and disposed at a spaced distance from the horizontal axis of the other disc to define an area of overlap in respect to the adjacent faces, said spaced distance being not more than five percent of the radius of each disc, means for rotating each disc in an opposite direction relative to the other at selected speeds of rotation, means for delivering the articles to be ground to said area of overlap through an entrance apex to the spacing defined by a first overlap of the periphery of each disc relative to the other, said rotating means being operative to oppositely rotate each disc relative to the other at angular speeds which differ from each other by an amount of 1% to 5% of their values, to pass the articles from the entrance apex through a circular arc in said area of overlap and to a discharge apex from the spacing defined by a second overlap of the periphery of each disc relative to the other, and the path being variable as a function of selected speeds, said circular arc having a center lying in the common axial plane of the two discs arranged at a radial distance (x) from the axis of one disc, said radial distance being defined by the equation $$x = \frac{d \cdot w_2}{w_2 - w_1}$$

wherein d is the spacing between axes of the discs and $w_1$ and $w_2$ are the respective angular speeds of the discs, each disc having a central opening for supplying a cooling liquid into the spacing between said adjacent faces and wherein said circular arc intersects said common axial plane at the vicinity of the point at which the central opening of each disc overlaps relative to the other so that the articles project at this point over the edge of each central opening, and wherein said discs are arranged so that said entrance apex and said discharge apex are located on the same diametrical side of said discs.

2. A grinding device, as claimed in claim 1, including guide means extending in an arc into said entrance apex through said area of overlap between said discs and out said discharge apex for guiding the articles therebetween.

3. A grinding device, as claimed in claim 1, wherein said means for delivering articles to be ground includes a guide extending into the spacing between adjacent faces of the discs at the entrance apex.

4. A grinding device, as claimed in claim 1, further comprising a hood arranged around a portion of each disc adjacent the entrance apex, and including a portion forming said means for delivering the articles to be ground to the entrance apex.

* * * * *